United States Patent [19]

Mirliss et al.

[11] 4,057,908

[45] Nov. 15, 1977

[54] METHOD AND APPARATUS FOR DRYING DAMP POWDER

[75] Inventors: Melvin J. Mirliss, Long Beach; Richard B. Nielsen, Los Angeles, both of Calif.

[73] Assignee: Grefco, Inc., Bala Cynwyd, Pa.

[21] Appl. No.: 688,462

[22] Filed: May 20, 1976

[51] Int. Cl.[2] ..... F26B 3/08; F26B 17/00; F27B 15/00

[52] U.S. Cl. ..... 34/10; 34/57 A; 432/13; 432/58

[58] Field of Search ..... 432/13, 58; 34/10, 57 A

[56] References Cited

U.S. PATENT DOCUMENTS

| | | | |
|---|---|---|---|
| 2,306,462 | 12/1942 | Moorman | 432/13 |
| 2,421,902 | 6/1947 | Nevschotz | 432/13 |
| 2,538,833 | 1/1951 | De Rycke | 34/10 |
| 2,838,881 | 6/1958 | Plumat | 432/13 |
| 3,201,099 | 8/1965 | Carpenter | 432/13 |
| 3,206,905 | 9/1965 | Wavering et al. | 432/58 X |

*Primary Examiner*—John J. Camby
*Attorney, Agent, or Firm*—Everett H. Murray, Jr.

[57] ABSTRACT

To dry fragile low density materials without damage, gas assisted injection and suspension of damp powder to a low velocity stream of heated gas followed by cyclone drying assures long residence time and produces a free-flowing product.

13 Claims, 3 Drawing Figures

METHOD AND APPARATUS FOR DRYING DAMP POWDER

BACKGROUND OF THE INVENTION

This invention relates to an apparatus and method for drying damp powders of fragile, low density materials. Drying of particulate and powdered materials is a step common to many manufacturing processes, and special techniques have been developed suited to production of individual products.

Characteristics of the end product, for example, whether the material is agglomerated or separated, control the method of drying. Considerable difficulty has been encountered in drying damp powders, such as glass bubbles and expanded perlite, which are fragile and have a low, real or apparent, density. The dried product must be a free-flowing powder substantially composed of unfractured individual particles and/or agglomerates as the process may require. Attempts to do this by conventional methods, for example, flash drying, fluid bed reactors and rotary calciners, have been unsuccessful and unsuitable. Commercial flash driers have too low a residence time for materials to be dried in the drying media; fluid bed reactors are ineffective with low density materials because of bed segregation, over agglomerating, and difficulty in control of operating parameters. Rotary kilns produce clinkers and large agglomerates which must be removed from the product, and the end product does not flow freely. Commercial spray driers do not have the required residence time due to the air flow patterns of these devices.

What is needed is an economic process which dries damp powdered materials, particularly those of low density, to produce a lightweight free-flowing product comprised of unfractured particles.

SUMMARY OF THE INVENTION

In this invention damp powders feed by gravity into a stream of air flowing through a venturi nozzle. The damp material is conveyed into, and is suspended in, a moving stream of heated air. The heated air stream then passes via a generally unobstructed path into a cyclone chamber where drying is accomplished. A sharp reversal in direction of air flow and centrifugal action in the cyclone drier combine to separate the dried solid materials from the air stream. Low air velocities and the extended flow path in the cyclone provide a long residence time, four to five seconds or more, of material in suspension; and the low energy applied in the venturi nozzle and an unobstructed and expanding flow path prevent fracture of individual particles.

OBJECTS OF THE INVENTION

An object of the present invention is the provision of a method and apparatus to economically dry damp powdered materials.

Another object is to provide drying for materials of low density and to produce a free-flowing product.

A further object of the present invention is to produce a dried product comprised of unfractured materials.

Still another object is to provide a long residence time for materials in the drying media.

A still further object is to accomplish drying economically and with low energy input.

Other objects, advantages, and novel features of the present invention will become apparent from the following detailed description of the invention when considered in conjunction with the accompanying drawing, in which.

DESCRIPTION OF THE INVENTION

Figure 1:
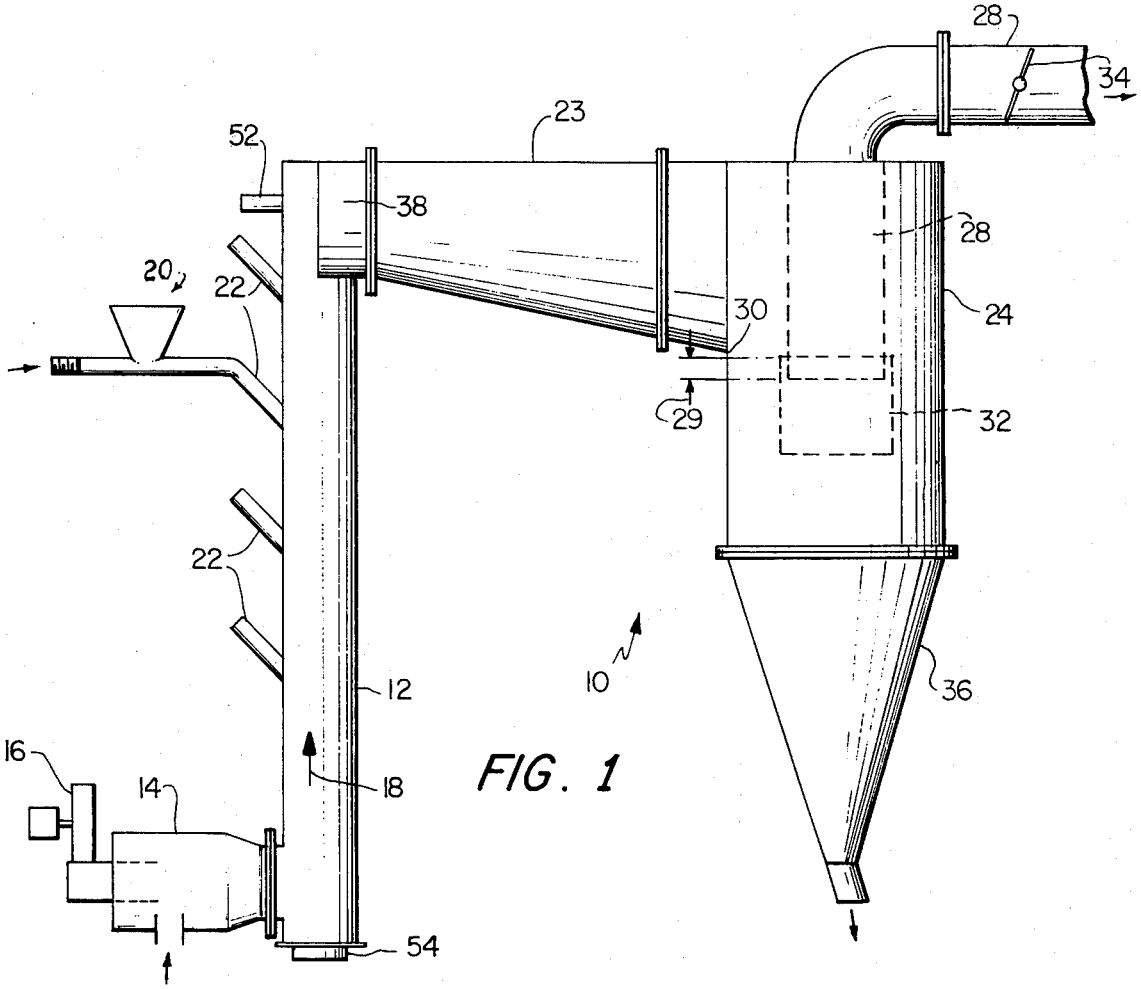
FIG. 1 is a front elevational/view of the damp powder drier of this invention.
Figure 2:
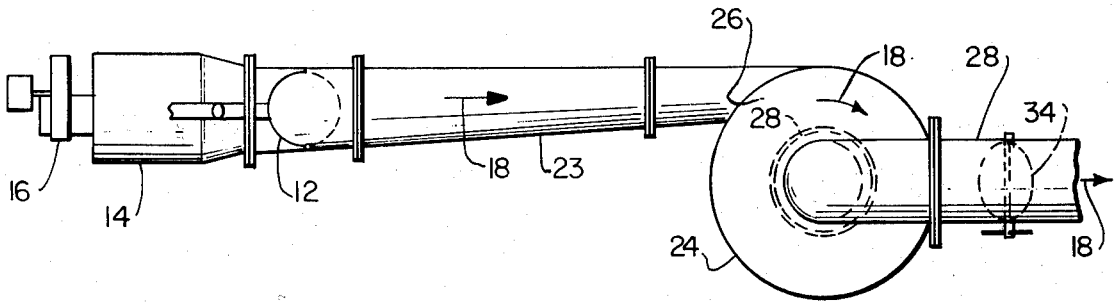
FIG. 2 is a plan view of the damp powder drier of FIG. 1.
Figure 3:
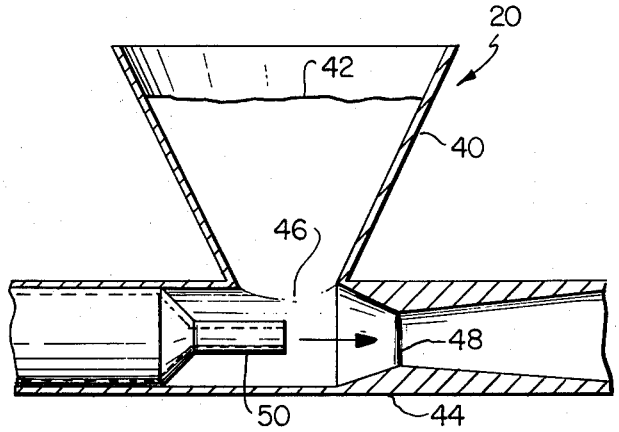
FIG. 3 is an enlarged fragmentary section of the feeder assembly of the drier of FIG. 1.

The damp powder drier 10 of this invention is comprised of an extended vertical cylindrical duct 12 through which flows an upwardly moving stream of air supplied in a heated condition in a known manner by a blower 14 in combination with a burner 16. The direction of air flow is generally indicated by the arrows 18. A feeder assembly 20 allows damp powder to be introduced into the vertical duct 12 through any one of a plurality of feed ports 22 vertically displaced along the duct 12. A horizontal transition duct 23 of extended length connects between the upper air discharge end of the vertical duct 12 and the generally tangential inlet 26 to a vertically oriented cylindrical cyclone chamber 24.

A circular air discharge duct 28 within the chamber is concentric with the generally vertical longitudinal axis of the cyclone chamber 24 and has a lower opening positioned a distance 29 FIG. 1 below the lower edge 30 of the tangential inlet. An extension, 32, to the vortex finder, 28, allows the residence time and air flow pattern inside the cyclone drier to be controlled. A damper 34 of the well known butterfly type limits the discharge area and thereby permits control over the velocity of air flow through the drier 10 of this invention.

An inverted cone 36 is attached to the lower end of the cylindrical chamber 24, the angle of the cone is such that the dried product can be discharged easily.

Heated air entering the cylindrical chamber 24, carrying suspended particles in the process of drying, follows generally the curvature of the walls of the cylinder and has induced therein a whirling cyclonic motion. Thus, the air circles around the discharge duct 28, moving gradually inward as it travels downwardly to the bottom inlet of said discharge duct.

In the cyclone chamber 24 the particles to be dried, being heavier than air, move outwardly toward the walls of the chamber 24 under the influence of centrifugal forces induced by the swirling air. Thus, the particles are in a zone of diminished velocity and fall toward the collection hopper 36. Additionally, as explained hereinafter, the upward velocity of air into the opening of the inlet duct 28 is no longer sufficient to lift the particles against the force of gravity.

After the material is suspended in the air stream of the vertical duct 12, the cross-sectional area for air flow generally increases or remains constant with each transition between elements in the path of flow through the drier 10 of this invention; there are no decreases in flow area while the powder is airborne. More specifically, the cross-sectional flow area of the vertical duct 12 is substantially constant; the flow area of the horizontal duct 23, though in transition of shape between a squarish rectangle at its inlet 38 to an elongated rectangle at its outlet 26 (FIG. 1, 2), is substantially constant and larger than the flow area in the vertical duct 12. The effective annular flow area in the downward-spiraled direction of flow in the cylindrical cyclone chamber 24 exceeds the flow area in the horizontal duct 23, and the discharge duct 28 flow area is generally less than the flow area of the chamber 24.

Thus, the air velocity in the drier 10 of this invention decreases without any substantial intervening increase in progressive steps in the direction 18 of air flow and extends the residence time of suspension of material to be dried in the drier 10. Residence times of 4 to 5 seconds and greater have been achieved and provide satisfactory performance yielding a free-flowing powder. Elimination of baffles, turning vanes and constrictions in the air flow path avoid velocity accelerations and impingements of particles which can fracture the structure of fine particles such as glass bubbles and expanded perlite.

The feeder assembly 20 is comprised of a cone with an angle sufficiently steep so as to permit the feed material to flow freely to the horizontally oriented venturi nozzle 44. An open passage 46 connects the apex of the cone 40 to the venturi channel at a point upstream of the constriction 48. A nozzle 50 delivers a jet of compressed air, generally along the longitudinal centerline of the venturi nozzle 44, which engages the damp powdered material 42 as it falls from the feed cone 40 under the force of gravity into the flow channel of the venturi 44. The velocity of the jet, enhanced by the contraction at the throat 48 of the venturi 44 causes the well known venturi effect which draws damp material through the feeder. The feeder assembly 20, described above, operates from a relatively low pressure air source (not shown) but the quantity of air supplied is sufficient such that powder to be dried is delivered into the main gas duct 12 in a dispersed state and with the integrity of the individual particles or agglomerates intact. An air nozzle with a 0.093 inch orifice, operating from a source of air at less than 50 psig and discharging through a venturi 2.375 inches long, having a 11/32 inch diameter throat and 0.656 inch diameter inlet and outlet ports produces satisfactory results in delivering approximately 15–30 pounds per minute of damp perlite powder.

The feeder assembly 20 is connected to one of a plurality of feeder ports 22 which enter the vertical duct 12 at a downward pointing angle. A 45° angle has operated satisfactorily. The extended longitudinal centerline of the feeder ports generally intersect the longitudinal centerline of the vertical duct 12. The downward angle of entry increases turbulence at the mixing point of the two air streams i.e., the blower stream and the feeder assembly stream, to enhance suspension and separation of damp particles in the air stream. The plurality of feeder ports 22 provides flexibility of the drier 10 to accommodate individually a plurality of materials. By variation in the length of the flow path through selection of a feed port 22, the time of residence in suspension of materials to be dried is varied in accordance with the specific material properties and requirements of the drying process. A horizontal feed port 52 bypasses the vertical duct 12 and allows injection of damp material directly into the horizontal duct 23 thereby slightly reducing residence time when required.

A waste trap 54 at the lower end of the vertical duct 12 collects any large or agglomerated solid materials which are not successfully suspended in the up-moving air stream.

In operation, the blower 14 and burner 16 provide a main flow of heated air moving upward through the vertical duct 12 while simultaneously the feeder assembly 20 continuously delivers material to be dried, mixed with a relatively small quantity of air, generally transversely into the main flow stream of heated air. The damp material suspended in the hot air, and in the process of giving over its moisture to the air, leaves the upper end 38 of the vertical duct 12 and is conveyed by the air stream through the horizontal duct 23 from which it is discharged substantially tangentially with the circular wall of the cyclone chamber 24. Drying continues in the cyclone chamber 24, the dry powder falling into the hopper 36 below and the air leaving the drier via the central air discharge duct 28 as described above. Heated air volume and velocity is sufficient at minimum flow rate to retain the particles in suspension in the vertical duct 12 and to provide the thermal energy required for drying. Residence time of suspended material in the drier may be reduced by increasing the air flow and vice versa.

Additionally, residence time may be varied as required to accomplish drying and accommodate individual product characteristics by selection of the feeder port 22, 52 to increase or decrease flow length of the drier 10 as described above.

An embodiment which satisfactorily dried damp expanded perlite powder to provide a free-flowing unfractured product had approximate dimensions as follows: The vertical duct 12 had a 4 inch diameter, length of 150 inches and five feed ports spaced 7 inches apart. The horizontal duct had a length of 13 inches and a maximum height of 13 inches. The cyclone drying chamber was 12 inches in diameter and 16 inches long; the discharge duct was 4 inches in diameter and extended 14 inches into the cyclone chamber. The conical hopper was 16 inches long.

The primary air flow approximately 27 cubic feet per minute entering at a temperature of 1200° Fahrenheit. Feed ports were ¾ inch pipes, 6 inches long and feed rate of damp perlite powder was 25 pounds per hour.

It should be understood that the embodiment of this invention described above is by way of illustration and example and is not to be taken as a limitation of the spirit and scope of this invention. For example whereas five feed ports are described above, the number of such feed ports need not be so limited or so extensive and in an alternative embodiment any number of feed ports may be provided. Also, the feed ports need not be downwardly directed or directly toward the vertical axis of the vertical duct as described above but in an alternative embodiment may be horizontally or upwardly oriented and may even enter tangentially to the wall of the vertical duct. Also, in an alternative embodiment the venturi feed of the damp material may be replaced with another type feed, e.g., a screw conveyor. And in another embodiment another gas other than air may serve as the suspending medium as suits the process and the end product. Also, during operation in an alternative embodiment a plurality of feed ports may be used simultaneously to deliver material to be dried. In yet another embodiment the feed ports may be eliminated and the venturi outlet may be connected directly to the vertical duct.

In yet another alternative embodiment the cross-section area of the discharge duct may be less than the flow area in the cyclone chamber because drying is complete prior to that exit zone and the air and dry material no longer follow the same flow path.

What is claimed is:

1. A damp powder drier for producing unfractured particles or agglomerates, said drier comprised of:

an extended duct having an inlet end and an outlet end;

an enclosed volume having generally circular side walls;

supply means, including a feed port, to provide a continuous supply of damp material to be dried to said extended duct;

means to provide a flow of heated gas into the inlet end of said extended duct, said heated gas moving within said duct at low velocity and sufficient to suspend said damp material in said gas flow;

delivery means connecting said outlet end of said duct of extended length to said enclosed volume and providing entrance to said enclosed volume generally tangentially to said circular side walls thereof whereby a swirling motion is induced in said gas; and discharge means to collect dried material from said enclosed volume and to exhaust said gas from said chamber by a separate path, said extended duct, said enclosed volume and said delivery means being unobstructed and providing in combination an unobstructed flow path for said gas.

2. The damp powder drier of claim 1 wherein the cross-sectional area for flow of said gas increases progressively without decrease in the direction of flow of said gas whereby velocity decelerates without acceleration in the direction of said gas flow and residence time of material suspended in said gas flow is increased.

3. The damp powder drier of claim 1 wherein said extended duct is vertical, said enclosed volume is a vertical cylinder, said delivery means are horizontal and extended, said discharge means is a vertical duct, and the direction of said gas flow in said extended duct and in said discharge means is upward.

4. The damp powder drier of claim 3 wherein said feed port points downward.

5. The damp powder drier of claim 1 wherein said feed port is oriented at a non-perpendicular angle to the longitudinal axis of said extended duct and in opposition to the direction of air flow whereby damp powder enters said gas flow from said feed port in a counter-flow-crossflow relationship to said gas flow.

6. The damp powder drier of claim 1 wherein said damp powder supply means includes a jet of gas intermixing with said damp powder prior to supplying said feed port.

7. The damp powder drier of claim 6 wherein said gases are air.

8. The damp powder drier of claim 1 wherein said damp powder supply means is comprised of a venturi nozzle, a gas jet at the inlet to said venturi nozzle, a storage bin for damp powder communicating with said venturi nozzle upstream of the throat of said nozzle, and an outlet from said venturi nozzle connected to said feed port.

9. The damp powder drier of claim 1 wherein said extended duct is horizontal.

10. The method for drying damp powder comprised of the steps of:

feeding damp powder to be dried into a low velocity flow of heated gas;

suspending said damp powder in said low velocity flow of gas;

decreasing without increasing the velocity of said flow of gas and said suspended powder in progressive stages along the flow path of said gas and said suspended powder; and separating the powder, when dried, from said flow of gas.

11. The method for drying damp powder of claim 10 further comprised of the step of mixing said damp powder with gas before feeding said powder into said flow of heated gas.

12. The method of claim 11 wherein said damp powder is expanded perlite.

13. The method of claim 11 wherein said damp powder is glass bubbles.

* * * * *